US008035081B2

(12) United States Patent
Sittler

(10) Patent No.: US 8,035,081 B2
(45) Date of Patent: Oct. 11, 2011

(54) HIGH PRECISION ELECTRIC GATE FOR TIME-OF-FLIGHT ION MASS SPECTROMETERS

(75) Inventor: Edward C. Sittler, Crofton, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 199 days.

(21) Appl. No.: 12/570,166

(22) Filed: Sep. 30, 2009

(65) Prior Publication Data

US 2011/0073754 A1 Mar. 31, 2011

(51) Int. Cl.
*H01J 49/40* (2006.01)

(52) U.S. Cl. ..... 250/287

(58) Field of Classification Search ..... 250/287, 250/281, 282

See application file for complete search history.

(56) References Cited

U.S. PATENT DOCUMENTS 6,037,586 A * 3/2000 Baril ..... 250/287
6,770,870 B2 * 8/2004 Vestal ..... 250/281

* cited by examiner

*Primary Examiner* — Kiet Nguyen
(74) *Attorney, Agent, or Firm* — Christopher O. Edwards

(57) ABSTRACT

A time-of-flight mass spectrometer having a chamber with electrodes to generate an electric field in the chamber and electric gating for allowing ions with a predetermined mass and velocity into the electric field. The design uses a row of very thin parallel aligned wires that are pulsed in sequence so the ion can pass through the gap of two parallel plates, which are biased to prevent passage of the ion. This design by itself can provide a high mass resolution capability and a very precise start pulse for an ion mass spectrometer. Furthermore, the ion will only pass through the chamber if it is within a wire diameter of the first wire when it is pulsed and has the right speed so it is near all other wires when they are pulsed.

20 Claims, 4 Drawing Sheets

HIGH PRECISION ELECTRIC GATE FOR TIME-OF-FLIGHT ION MASS SPECTROMETERS

ORIGIN OF THE INVENTION

The invention described herein was made by an employee of the United States Government and may be manufactured and used by or for the Government of the United States of America for governmental purposes without the payment of any royalties thereon or therefore.

FIELD OF THE INVENTION

The present invention relates to a mass spectrometer in general and in particular to a high precision electric gate for a time-of-flight (TOF) ion mass spectrometer (IMS).

BACKGROUND OF THE INVENTION

Mass spectrometers are used extensively in the scientific community to measure and analyze the chemical compositions of substances. In general, a mass spectrometer is made up of a source of ions that are used to ionize neutral atoms or molecules from a solid, liquid, or gaseous substance, a mass analyzer that separates the ions in space or time according to their mass or their mass-per-charge ratio, and a detector. Several variations of mass spectrometers are available, such as magnetic sector mass spectrometers, quadrupole mass spectrometers, and time-of-flight ion mass spectrometers.

Time-of-flight ion mass spectrometers (TOF-IMS) can detect ions over a wide mass range simultaneously. Mass spectra are derived by measuring the times for individual ions to traverse a known distance through an electrostatic field free region. In general, the mass of an ion is derived in TOF-IMS by measurement or knowledge of the energy, E, of an ion, measurement of the time, $t_1$, that an ion passes a fixed point in space, $P_1$, and measurement of the later time, $t_2$, that the ion passes a second point, $P_2$, in space located at a predetermined distance, d, from $P_1$. Using an ion beam of known energy-per-charge E/q, the time-of-flight ($t_{TOF}$) of the ion is $t_{TOF}=t_2-t_1$, and by the ion speed. In a gated TOF-IMS uncertainty in $t_{TOF}$ may result, for example, from ambiguity in the exact time that an ion entered the spectrometer.

One method of attempting overcome this limitation in TOF-IMS utilizes a thin foil located at the entrance to spectrometer. The thin foil method works best with ions having sufficient energy to traverse the foil. Secondary electrons generated by the interaction of the ion with the foil are detected and provide an indication of when the ion entered the spectrometer. However, the foil method is not without its own limitations. These limitations include the requirement that the incident ion have sufficient energy to transit the foil, the energy degradation of the sample ion due to interaction with the foil, and the angular scattering of the sample ion due also to its interaction with the foil.

For the reasons stated above, and for other reasons stated below which will become apparent to those skilled in the art upon reading and understanding the present specification, there is a need in the art for resolving when the time that at least one ion entered the spectrometer without substantially reducing the energy of the at least one ion

BRIEF DESCRIPTION OF THE INVENTION

The above-mentioned shortcomings, disadvantages and problems are addressed herein, which will be understood by reading and studying the following specification.

In one aspect of the invention, there is provided a gating apparatus in an ion mass spectrometer comprising a chamber having opposite plates, wherein the chamber has an entrance opening and an exit opening; a plurality of electrodes position on one of the opposite plates, wherein the electrodes are aligned and spaced along a common axis; a voltage source to create an electric potential across the opposite plates to deflect ions away from the entrance opening; and an electric gate to sequentially apply an electrical signal to each of the plurality of electrodes, wherein the electrical signal causes an opening event to occur allowing at least one ion to enter the chamber through the entrance opening. The electric gate allows for a spectrometer that can select ions meeting both mass and velocity requirements.

In yet another aspect, a field programmable gate array generates a plurality of pulses with temporal pulse width and pulse frequency that push an ion away from the plate having the plurality of electrodes.

In still another aspect of the invention, a method for gating an ion mass spectrometer by applying an electrical signal to each of the plurality of electrodes, wherein the electrical signal causes an opening event to occur allowing at least one ion to enter a chamber through the entrance opening. The electrical signal is a series of pulses that is a function of the position of the plurality of electrodes and ion velocity. The spectrometer uses the pulse applied to the electrode closest to the entrance opening of the chamber as the start time when the ion enters the chamber.

In yet another aspect, a time-of-flight ion mass spectrometer comprising a chamber with entrance opening and exit opening; a plurality of electrodes position on a plate inside the chamber, wherein the electrodes are aligned and spaced along a common axis; a voltage source to create an electric potential across the plate to deflect ions away from the entrance opening; a field programmable array to generate an electric field in the chamber, wherein the electrical field causes an opening event to occur allowing at least one ion to enter the chamber through the entrance opening; and a timer to determine an elapsed time of at least one ion at a predetermined location after the exit opening. The electric field is created from a series of pulses having a pulse frequency that is a function of the position of the plurality of electrodes and ion velocity. The pulse width is between 1 ns to 100 ns and the pulse frequency is between 2 ns to 100 ns.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

The disclosed embodiments include a time-of-flight mass spectrometer having a chamber with electrodes to generate an electric field in the chamber and electric gating for allowing ions with a predetermined mass and velocity into the electric field. The design uses a row of very thin parallel aligned wires that are pulsed in sequence so the ion can pass through the gap of two parallel plates, which are biased to prevent passage of the ion. This design by itself can provide a high mass resolution capability and a very precise start pulse for an ion mass spectrometer. Furthermore, the ion will only pass through the chamber if it is within a wire diameter (295) of the first wire when it is pulsed and has the right speed so it is near all other wires when they are pulsed.

The electric gating can be used for all ion and neutral mass spectrometers that use time-of-flight (TOF) technology. It can be used to make miniature mass spectrometers of high capability. It can be used for planetary atmospheres and ionospheres, planetary magnetospheres, comets and the exospheres of moons such as our own. It can be used for orbiting platforms, balloons, and Landers. The device can be used for biotechnology applications where mass spectrometry is needed and can be used by homeland security to detect molecules of interest with low profile devices. Due to its small size it may have application when large arrays of miniature mass spectrometers are needed for industrial applications. It is envisioned that the device can be put into a small vacuum tube configuration with small inlet with internal getter pumps for short term usage (getter pumps can be baked out for reuse). The main challenge for size reduction is the processing hardware, miniature pulse generator, and miniature HV supply for miniature microchannel plate detector or equivalent. The electronics could be used to run many of these small devices in parallel.

Figure 1:
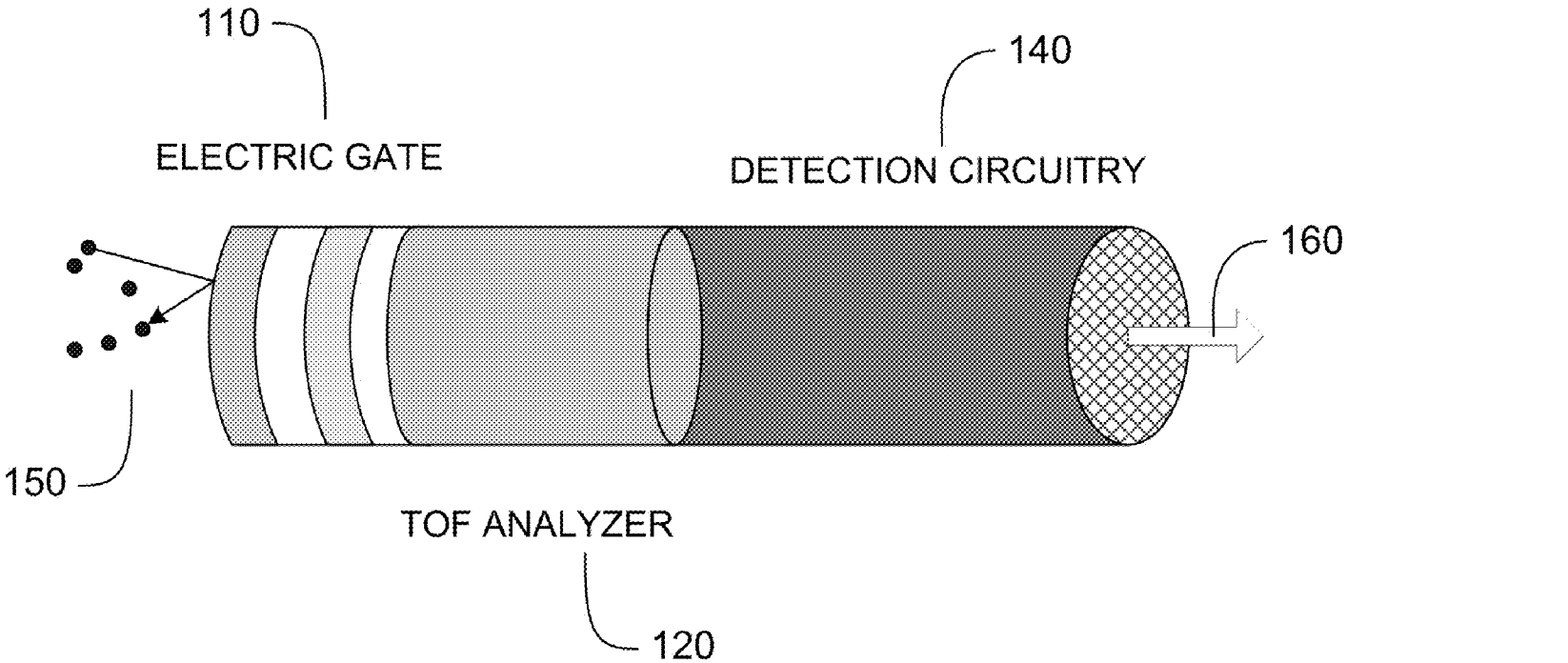
FIG. 1 is an illustration of a time-of-flight ion mass spectrometer (TOF-IMS) with an electric gate in accordance to an embodiment.

FIG. 1 is an illustration of a time-of-flight ion mass spectrometer (TOF-IMS) 100 with an electric gate in accordance to an embodiment. The TOF-IMS 100 comprises an electric gate 110, a time-of-flight mass analyzer 120, a detection circuitry 140, and an ionizing source 150 at the entrance opening to the electric gate and a signal output 160 at the detection circuitry.

The ionizing source 150 can be any radiation source, such as a laser radiation source, an electron beam, an ion source, a fast (energetic) atom source, or an ion source generated by a natural source or by the interaction of materials that causes ions to be generated or emitted. Similarly, the ions to be analyzed can also be generated by impinging an ion beam on the sample of material. The ionizing source 150 can also be a plasmatron, i.e. a plasma discharge ion source which can, for example, use radio-frequency to induce ionization and formation of ions in the sample material.

The detection circuitry 140 or detector can be selected from any commercially available charged particle detector. Such detectors include, but are not limited to, an electron multiplier, a channeltron or a micro-channel plate (MCP) assembly. An electron multiplier is a discrete dynode with a series of curved plates facing each other but shifted from each other such that an ion striking one plate creates secondary electrons and then an avalanche of electrons through the series of plates. A channeltron is a horn-like shaped continuous dynode structure that is coated on the inside with an electron emissive material. An ion striking the channeltron creates secondary electrons resulting in an avalanche effect to create more secondary electrons and finally a current pulse. A microchannel plate is made of a leaded-glass disc that contains thousands or millions of tiny pores etched into it. The inner surface of each pore is coated to facilitate releasing multiple secondary electrons when struck by an energetic electron or ion. When an energetic particle such as an ion strikes the material near the entrance to a pore and releases an electron, the electron accelerates deeper into the pore striking the wall thereby releasing many secondary electrons and thus creating an avalanche of electrons. Optionally, the detection circuitry may include transporting elongated electrodes, magnetic sector or Wien filter, quadrupole mass filter, storage RF multipole with resonant or mass-selective ion selection, 3D quadrupole ion trap, or linear trap with radial or axial ejection.

The time-of-flight mass analyzer 120 can be a linear flight tube or a reflectron. The ion detector typically consists of microchannel plate detector or a fast secondary emission multiplier (SEM) where first converter plate (dynode) is flat. The electrical signal from the detector is recorded by means of a time to digital converter (TDC) or a fast analog-to-digital converter (ADC). TDC is mostly used in combination with orthogonal-acceleration (oa) TOF instruments. Time-to-digital converters register the arrival of a single ion at discrete time bins, thresholding can be used to discriminate between noise and ion arrival events. The electric gate can be tuned for a specific mass range and then the gate will be used to provide a precise start pulse for the TOF section. The use of the energy analyzer removes the uncertainty in the ion mass since atmospheric winds, thermal width of ion distribution function and spacecraft potentials are a priori not known (space application). If one first focuses on the dominant ion and then uses the retarding grid mode first, one can determine the ion temperature, wind estimate and spacecraft potential estimate. Once known, one can scan the mass range using the electric gate with high precision and then determine the ion composition with very high mass resolution capability.

Figure 2:
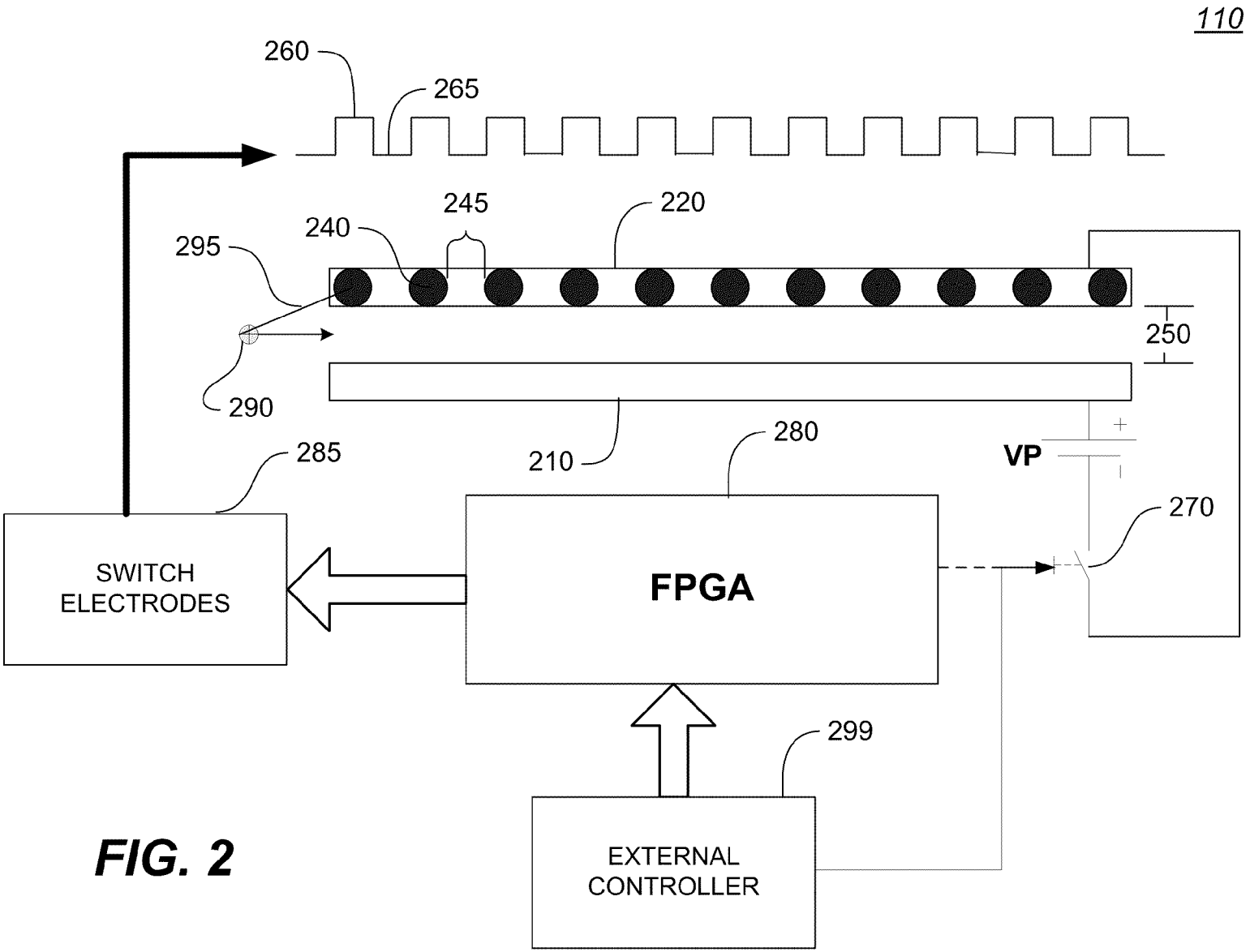
FIG. 2 is an illustration of the electric gate for a time-of-flight ion mass spectrometer (TOF-IMS) in accordance to an embodiment.

FIG. 2 is an illustration of the electric gate 110 for a time-of-flight ion mass spectrometer (TOF-IMS) in accordance to an embodiment. The electric gate comprises opposite plates 210 & 220, a plurality of wires 240 aligned a common axis, a field programmable array 280, a voltage source (VP), and switching circuitry 285 for sequentially energizing the plurality of electrodes. The electric gate can be encased in chamber with an entrance opening and an exit opening. The electric gate includes at least two parallel plates separated by gap 250. One of the opposite plates includes a plurality or series of electrodes/wires 240 that can range from 1 to 30 microns in diameter. The wires are aligned along an axis (Y-axis shown) direction and spaced a predetermined distance apart 256 microns apart in a second axis (X-axis shown). The gap between the opposite plates is about 75 microns. The number of wires and diameter of the wires is based on the desired precision. The opposite plates are biased so ions cannot pass through, deflected up towards wires, unless when they pass each wire they are pushed away from the top plate, if the wire is pulsed at just the right time. The precision is given by the wire diameter over ion speed and the precision of each pulse (260,265) which is around 0.2 ns (nanoseconds). Then as the ion passes each wire they are pushed away, if the wire is pulsed as they pass each wire, and the ions have right time of entry and right speed they pass through the gate. With 1 mil (25.4 micron) wires the spectrometer 100 has a mass resolution capability of M/dM>1000. A 12-15 micron wire the spectrometer 100 has a mass resolution capability of M/dM>10000.

A voltage (VP) is applied across the opposite plates along a third axis (Z-axis) such that heavier ions 290 will require a higher voltage. The voltage (VP) is such that an ion moving in the direction of the second axis (X-axis) cannot successfully pass through the gap between the plates because the ion would be deflected downward (Z direction). The voltage source (VP) creates an electric potential across the opposite plates to deflect ions away from the entrance opening. The wires 240 are pulsed in sequence just when the ion passes each wire and pushes ion away from top plate 220. Without the series of pulses the ion cannot pass through the gate. The wires can be referred to as push electrodes and the applied voltage 260 (VT). The VP and VT voltages will be proportional to the ion mass (M). Furthermore, the ion 290 will only pass through the gate if is within a wire diameter of the first wire when it is pulsed and has the right speed so it is near all the other wires when they are pulsed. The time (dt) between pulses 265 is set by the distance between wires 245 (dw) and the ion speed (v). The pulse generator or FPGA 280 needs to be able to provide fast pulses with widths varying between 1 ns and 100 ns and be able to space pulse from a 1 ns to 100 ns. The max number of pulses per event is 20 wires. Since the initial ion speed determines whether the ion will be at the required wire when it is being energized the gate acts as a velocity filter. The ion can be pre-accelerate the ions by $VPA=0.5*Mv^2$ and using the mass to charge ratio one can produce a miniature mass spectrometer. A field programmable array (FPGA) 280 can cause control voltages VP and VT, the width and amplitude of the pulse 260, and the time between each pulse 265 at a particular pulse frequency. The FPGA can activate switch 270 to cause voltage VP to be applied across the opposite plates. An external controller 299 can also be used to activate switch 270, activate FPGA 280, and can be used to program the properties of the series of pulses so to select an ion having a desired mass (m) and a desired velocity (v).

Various techniques are described for high resolution time measurement using a programmable controller, such as an FPGA. The timing may be triggered by any event, depending on the applications of use. However, once triggering has occurred, a start pulse begins propagating through the FPGA. Ordinarily, propagation would be along columns of the array of circuit elements in the FPGA. Yet some of the present techniques stagger pulse propagation across different columns of the FPGA, to maximize the amount of time delay that may be achieved while minimizing the overall array size (and thus minimizing the environmental imprint) of the FPGA. The FPGA design has the capability of using a single start pulse to trigger timing measurement and multiple stop pulses to allow the time difference to be determined between many different events, without resetting timing operation. In this way the FPGA can be used as a timer to determine an elapsed time of at least one ion at a predetermined location after the exit opening just from the start pulse minus the stop pulse ($t_{TOF}=t_{stop}-t_{start}$).

The FPGA takes snapshots of its entire staggered delay line propagation each clock cycle and from this edge transitions are determined and timing between start and stop pulses are determined. By using a technique that may be used on small array sized FPGAs operating at relatively fast clock rates, high resolution time measurements between start and stop event can be performed in the nanosecond and sub-nanosecond range. For example, systems may be designed for TOF applications that require accuracies of 0.5 ns or better (from delay lines between 10 and 20 ns total) with adjustability up to at least 100 ns, for peak measurement rates of 100,000 events/second and higher.

Figure 3:
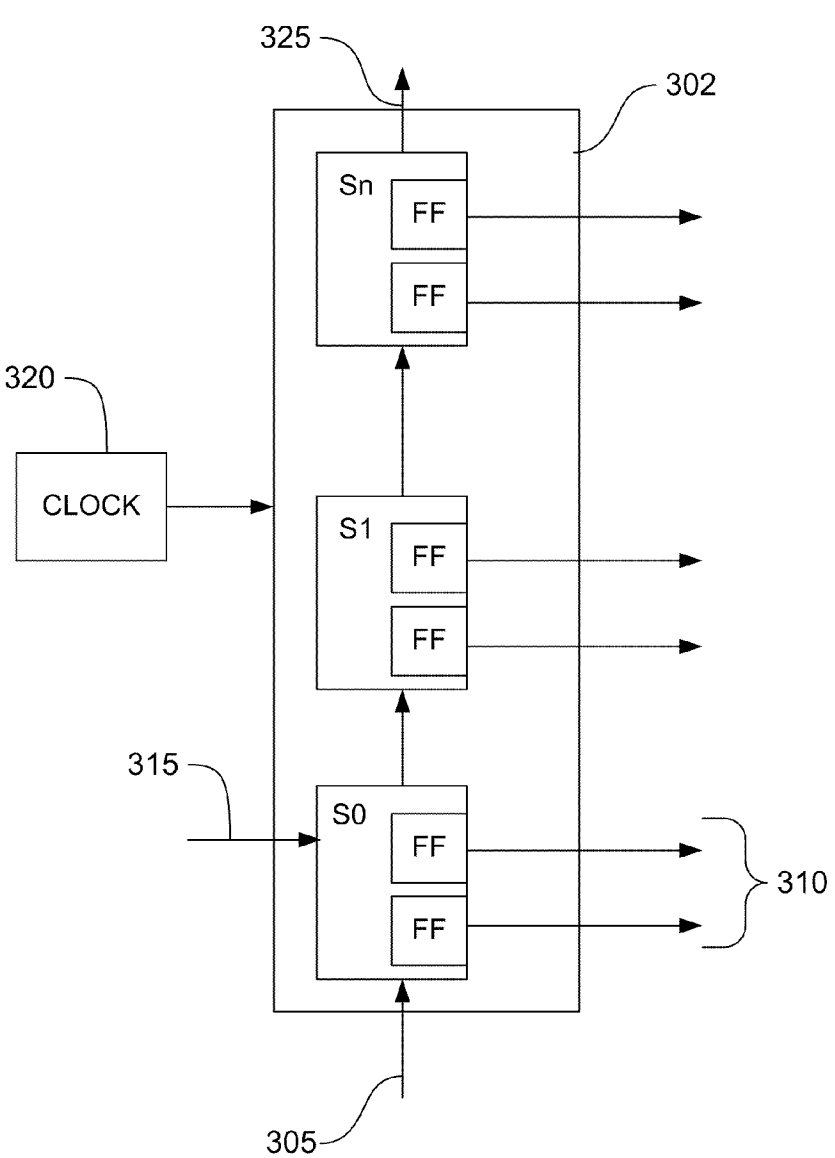
FIG. 3 illustrates an architecture that models properties of a pulse across a row/column in accordance to an embodiment; and, FIG. 4 is flowchart of a method for gating an ion mass spectrometer in accordance to an embodiment.

FIG. 3 illustrates an example FPGA 280 that may be configured to perform gating, generation of the series of pulses, or perform time-of-flight analysis. The FPGA 280 includes a plurality of identical unit circuits (limited number is shown for brevity) that operate as configurable logic blocks 302 (CLBs) as also shown. The FPGA 280 may be programmed using known techniques and to form functional circuit elements as discussed below. In general, each unit circuit comprises a CLB 302, and each CLB 302 which is constructed of two segments. Each unit circuit receives a clock signal 302, in this case a 1-100 MHz clock signal and uses that clock signal to drive data storage in its segments, each comprising a flip flop-based shift register or slice. Segment 315 includes slices $S_0$, $S_1$. The FPGA 280 is configured for input signals 305 entering the bottom of the FPGA 2280 to propagate along vertical columns of the FPGA. The CLB 302 receives an input signal for the respective row either from a preceding CLB or direct column entry like from external controller 299. The CLB 302 propagates that signal via a known delay through segments to the next circuit unit (not shown), in the column. The output 310 from segment 316 is coupled to a specific one of the plurality of wires 240 in plate 220. Each column will have a propagation time depending in part on the number of rows in the FPGA so as to be able to apply the pulse to the dedicated wire on plate 220. For small enough FPGAs, that column propagation time may be only the order of nanoseconds, for example, approximately 6 ns. However, while short propagation times are desirable for high resolution timing circuits, a signal in each column would traverse an entire column of the FPGA 200 and thus escape without detection before a single clock cycle has passed, depending on the speed of the FPGA clock. Delays could be introduced to cause the pulse to appear at the desired interval in the gating process.

Figure 4:
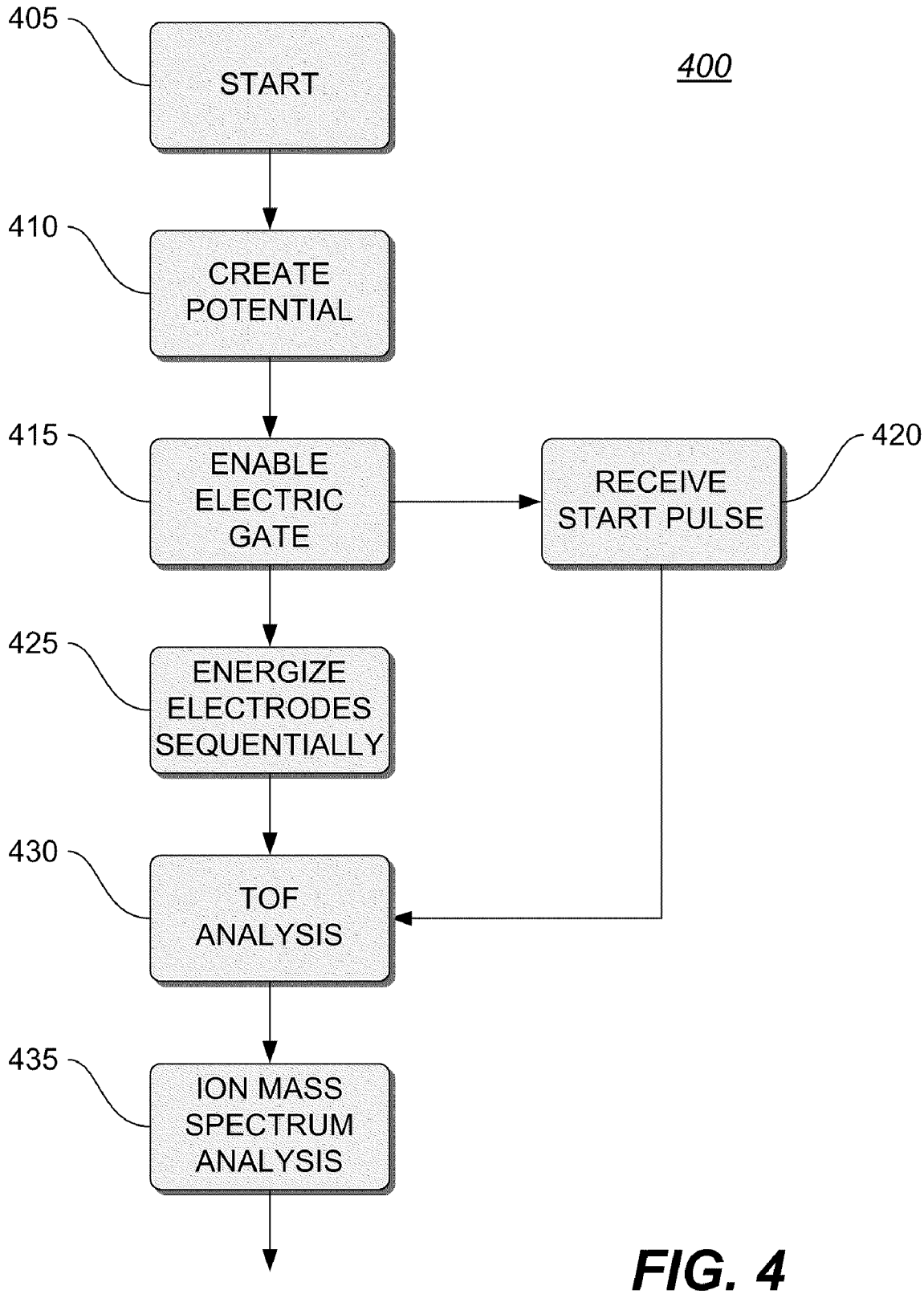

FIG. 4 is flowchart of method 400 for gating an ion mass spectrometer in accordance to an embodiment. Method 400 begins with a call to start the process at action 405. In action 410, a potential is created across opposites plates 210 and 220. As noted with reference to FIG. 2, the potential is voltage VP. In action 415, the electric gate is enabled by the injection of the start pulse from FPGA 280. This electrical signal causes an opening event to occur allowing at least one ion to enter the chamber through the entrance opening. However, only ions within one wire diameter (12.5 microns) 295 from the first wire will be able to enter the chamber and possible make it to the exit opening of the chamber. In action 420, the start pulse is readily available from the FPGA timing sequence as note in FIG. 3. In action 425, the electrodes or wires are sequentially pulsed by the FPGA. The electrodes are thus individually energized and ions that are too slow are stopped because they do not reach the pulsed wire in time for the opening event. In the case of ions that are fast enough to reach the wire slightly before the wire is pulse receive a push that is proportional to $VP_A=0.5*Mv^2$. In action 430 a time-of-flight analysis is performed by using the start pulse (FPGA) and the stop pulse (FPGA) or detection from a device upstream from the electronic gate 110. In action 435, a ion mass spectrum analysis can be performed from the capture timing data and the detection of the at least one ion at a suitable detector.

Embodiments as disclosed herein may also include computer-readable media for carrying or having computer-executable instructions or data structures stored thereon for operating such devices as controllers 299, sensors, and eletromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A gating apparatus in an ion mass spectrometer comprising:

a chamber having opposite plates, wherein the chamber has an entrance opening and an exit opening;

a plurality of electrodes positioned on one of the opposite plates, wherein the electrodes are aligned and spaced along a common axis;

a voltage source to create an electric potential across the opposite plates to deflect ions away from the entrance opening; and an electric gate to sequentially apply an electrical signal to each of the plurality of electrodes, wherein the electrical signal causes an opening event to occur allowing at least one ion to enter the chamber through the entrance opening.

2. The gating apparatus of claim 1, wherein the electrical signal is a plurality of pulses with temporal pulse width and the plurality of pulses are applied at a pulse frequency.

3. The gating apparatus of claim 2, wherein the pulse frequency is a function of the position of the plurality of electrodes and ion velocity.

4. The gating apparatus of claim 3, wherein the temporal pulse width is between 1 ns to 100 ns and the pulse frequency is between 2 ns to 100 ns.

5. The gating apparatus of claim 4, wherein the electric gate is a field programmable gate array.

6. The gating apparatus of claim 5, wherein the electrical signal pushes the at least one ion away from the plate having the plurality of electrodes.

7. The gating apparatus of claim 5, wherein a start time for time-of-flight analyses is the pulse applied to the electrode closest to the entrance opening of the chamber.

8. A method for gating an ion mass spectrometer comprising:

placing opposite plates in a chamber, wherein the chamber has an entrance opening and an exit opening;

positioning a plurality of electrodes on one of the opposite plates, wherein the electrodes are aligned and spaced along a common axis;

creating an electric potential across the opposite plates to deflect ions away from the entrance opening of the chamber; and applying an electrical signal to each of the plurality of electrodes, wherein the electrical signal causes an opening event to occur allowing at least one ion to enter the chamber through the entrance opening.

9. The method of claim 8, wherein the electrical signal is a plurality of pulses with temporal pulse width and the plurality of pulses are applied at a pulse frequency.

10. The method of claim 9, wherein the pulse frequency is a function of the position of the plurality of electrodes and ion velocity.

11. The method of claim 10, wherein the temporal pulse width is between 1 ns to 100 ns and the pulse frequency is between 2 ns to 100 ns.

12. The method of claim 11, wherein the electric signal is applied by a field programmable gate array.

13. The method of claim 12, wherein the electrical signal pushes the at least one ion away from the plate having the plurality of electrodes.

14. The method of claim 13, wherein a start time for time-of-flight analyses is the pulse applied to the electrode closest to the entrance opening of the chamber.

15. A time-of-flight ion mass spectrometer comprising:

a chamber with entrance opening and exit opening;

a plurality of electrodes positioned on a plate inside the chamber, wherein the electrodes are aligned and spaced along a common axis;

a voltage source to create an electric potential across the plate to deflect ions away from the entrance opening;

a field programmable array to generate an electric field in the chamber, wherein the electrical field causes an opening event to occur allowing at least one ion to enter the chamber through the entrance opening; and a timer to determine an elapsed time of at least one ion at a predetermined location after the exit opening.

16. The time-of-flight ion mass spectrometer of claim 15, wherein the field programmable array generates a plurality of pulses with temporal pulse width and the plurality of pulses are applied at a pulse frequency.

17. The time-of-flight ion mass spectrometer of claim 16, wherein the pulse frequency is a function of the position of the plurality of electrodes and ion velocity.

18. The time-of-flight ion mass spectrometer of claim 16, wherein the temporal pulse width is between 1 ns to 100 ns and the pulse frequency is between 2 ns to 100 ns.

19. The time-of-flight ion mass spectrometer of claim 18, wherein the electric field pushes the at least one ion away from the plate.

20. The time-of-flight ion mass spectrometer of claim 19, wherein the timer uses the pulse applied to the electrode closest to the entrance opening of the chamber.

* * * * *